US007541729B2

(12) United States Patent
Park

(10) Patent No.: US 7,541,729 B2
(45) Date of Patent: Jun. 2, 2009

(54) SULFUR LAMP HAVING ELECTRODES

(75) Inventor: Byeong-Ju Park, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 271 days.

(21) Appl. No.: 11/536,882

(22) Filed: Sep. 29, 2006

(65) Prior Publication Data

US 2007/0075617 A1 Apr. 5, 2007

(30) Foreign Application Priority Data

Sep. 30, 2005 (KR) ..... 10-2005-0092619

(51) Int. Cl.
*H01J 17/04* (2006.01)

(52) U.S. Cl. ..... 313/491; 313/633

(58) Field of Classification Search ..... 313/363, 313/633, 632, 631, 491
See application file for complete search history.

(56) References Cited

U.S. PATENT DOCUMENTS 5,757,130 A 5/1998 Dolan et al.
5,880,559 A * 3/1999 Fox et al. ..... 313/633
2002/0140381 A1* 10/2002 Golkowski et al. ..... 315/363

OTHER PUBLICATIONS

U.S. Appl. No. 11/536,924 to Park et al., which was filed on Sep. 29, 2006.

* cited by examiner

*Primary Examiner*—Joseph L Williams
(74) *Attorney, Agent, or Firm*—Greenblum & Bernstein, P.L.C.

(57) ABSTRACT

A sulfur lamp, is provided, including a power supply that supplies electrical power, a transparent bulb having a space inside that contains sulfur and a plurality of electrodes. Additionally, a portion of each electrode may be inserted into the space and an end of each electrode may be connected to the power supply such that the sulfur is excited by an electric discharge thereby emitting light. A portion of the electrode inserted into the space may be coated with a protective layer to prevent a chemical reaction of between the electrode and the sulfur. Further, the changing of the sulfur (contained in the space of the bulb) into a plasma phase may be accomplished by utilizing the electrodes (not microwaves). Therefore, a need to utilize a magnetron (which is low in energy transfer rate) may be eliminated, thereby increasing a system efficacy and saving a cost of replacing the magnetron.

24 Claims, 2 Drawing Sheets

SULFUR LAMP HAVING ELECTRODES

This application claims priority under 35 U.S.C. §119 to Korean Patent Application No. 2005-0092619, filed in Korea on Sep. 30, 2005, the entirety of which is hereby incorporated by reference.

BACKGROUND OF THE INVENTION

1. Field of the Invention

The present invention relates to a sulfur lamp. More particularly, the present invention relates to a sulfur lamp having electrodes, which eliminate the need to use a magnetron.

2. Description of the Background Art

There are various sources of lighting, e.g., an incandescent lamp using heat radiation, a fluorescent lamp including an electric discharge tube that uses a fluorescent material, a high intensity discharge (HID) lamp that uses an electric discharge within a high-pressurized gas or steam, and a plasma lighting system (PLS) lamp that uses an electrodeless discharge.

The various lamps have their respective advantages and disadvantages. For example, the incandescent lamp is excellent in color rendition and has a small size. However, the incandescent lamp is inefficient in emitting light and has a short life. Additionally, a switching-on-light circuit of the incandescent lamp is simple and low-priced. The fluorescent lamp is efficient in emitting light and has a relatively long life. However, the fluorescent light has a relatively large size when compared to the incandescent lamp. Additionally, the fluorescent lamp requires a subsidiary switching-on-light circuit. The HID lamp is light-efficient and has a long life, but requires a relatively large amount of time between switching off and on light. In addition, the HID lamp, like the fluorescent lamp, requires a subsidiary light-switching circuit. The PLS lamp has a much longer life, when compared to the above-noted lamps, and is efficient in emitting light. Although low in power consumption, the PLS lamp is relatively high-priced. In addition, the PLS lamp requires a subsidiary switching-on-light circuit.

The PLS lamp is the latest lamp. An electrodeless sulfur lamp, which belongs to the family of PLS lamps, is a highly-efficient full-spectrum electrodeless lighting system whose light is generated by sulfur plasma that has been excited by microwave radiation. The electrodeless sulfur lamp consists of a golf-ball sized quartz bulb containing several milligrams of sulfur power and argon gas at the end of a thin glass spindle. The bulb is enclosed in a microwave-resonant wire-mesh cage. A magnetron bombards the bulb with 2.45 GHz microwaves. The microwave energy excites the gas to five times atmospheric pressure, which in turn heats the sulfur to an extreme degree forming a brightly glowing plasma capable of illuminating a large area. At an initial stage of switching on light, the discharge occurs in argon which is a buffer gas. As temperature increases, the discharge occurs in sulfurous steam, thereby emitting white light which is excellent in color rendition.

The first prototype of the electrodeless sulfur lamps were 5.9 kW units, having a system efficacy of 80 lumens per watt. The first production models were 1.4 kW with an output of 135,000 lumens. Later models were able to eliminate the need for a cooling fan and improve efficiency to more than 100 lumens/watt.

A problem with the conventional electrodeless sulfur lamp is that the life of magnetron is short-lived when compared to the quartz bulb. The design life of the quartz bulb is currently approximately 60,000 hours. However, the design life of the magnetrons are currently only about 15,000 to 20,000 hours. This requires frequent replacement of the life-expired magnetrons with new ones before the life of the quartz bulb expires. The development in the magnetron generating the micro-wave is relatively slow, which contributes to lowering an energy transfer rate.

BRIEF DESCRIPTION OF THE INVENTION

Therefore, an objective of the present invention is to provide a electrode sulfur lamp having a high efficiency of emitting light and eliminates the need to use a short-lived magnetron (which has a low energy transfer rate).

According to an aspect of the present invention, there is provided a sulfur lamp A sulfur lamp, including a power supply that supplies electrical power, a transparent bulb having a space provided inside, with sulfur being contained in the space, and a plurality of electrodes, a portion of each electrode being inserted into the space and an end of each electrode being connected to the power supply such a that the sulfur is excited by an electric discharge thereby emitting light.

The foregoing and other objects, features, aspects and advantages of the present invention will become more apparent from the following detailed description of the present invention when taken in conjunction with the accompanying drawings.

BRIEF DESCRIPTION OF THE DRAWINGS

The present invention is further described in the detail description which follows, in reference to the noted plurality of drawings, by way of non-limiting examples of preferred embodiments of the present invention, in which like characters represent like elements throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present is invention may be embodied in practice.

Reference will now be made in detail to the preferred embodiments of the present invention, examples of which are illustrated in the accompanying drawings.

Figure 1:
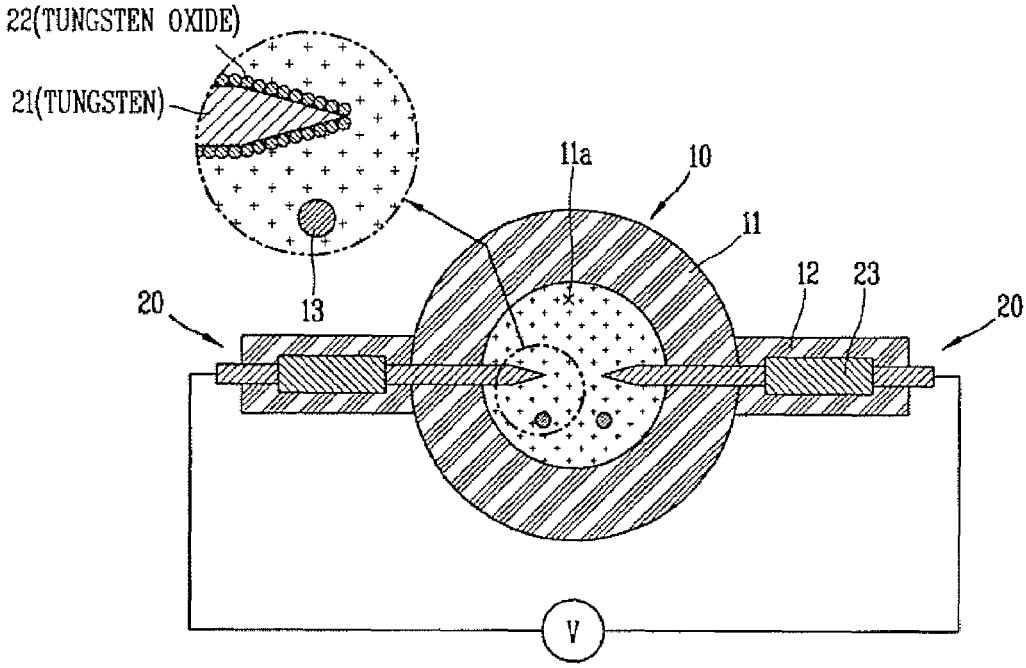
FIG. 1 is a cross-sectional view illustrating a sulfur lamp having metal electrodes according to a first embodiment of the present invention.
Figure 2:
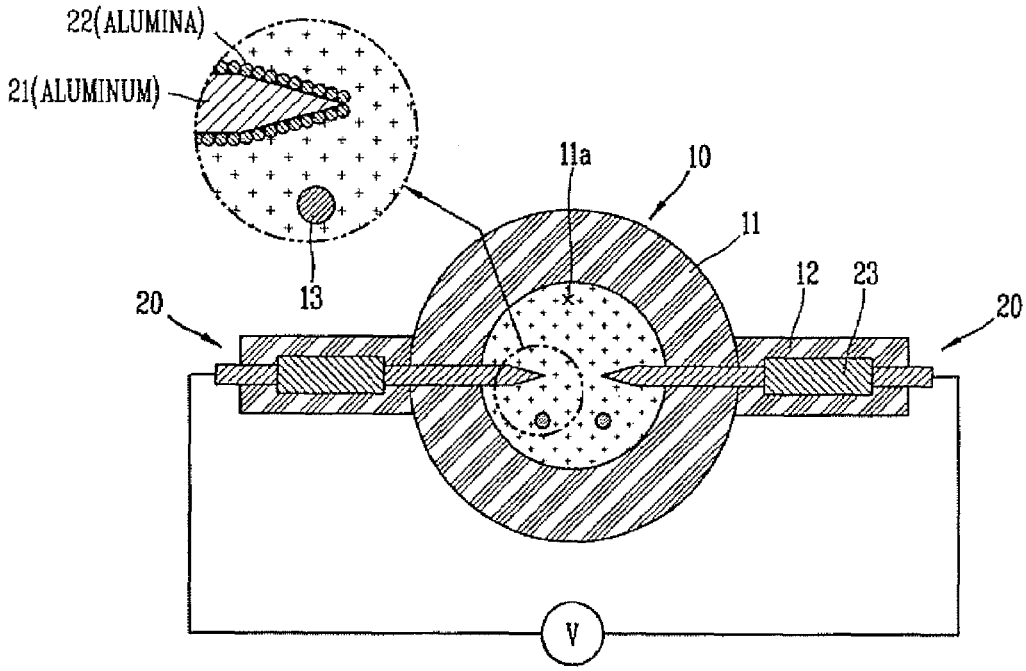
FIG. 2 is a cross-sectional view illustrating a sulfur lamp having metal electrodes according to a second embodiment of the present invention.
Figure 3:
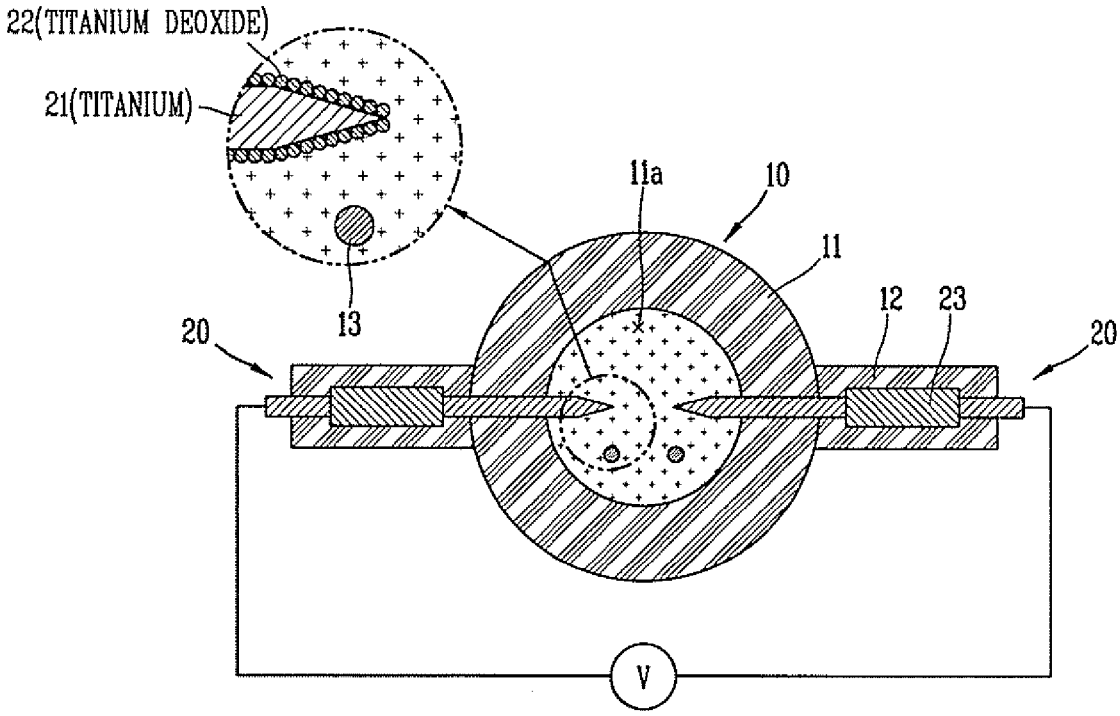
FIG. 3 is a cross-sectional view illustrating a sulfur lamp having metal electrodes according to a third embodiment of the present invention.

FIG. 1 is a cross-sectional view illustrating a sulfur lamp having metal electrodes according to a first non-limiting embodiment of the present invention. FIG. 2 is a cross-sectional view illustrating a sulfur lamp having metal electrodes according to a second non-limiting embodiment of the present invention. FIG. 3 is a cross-sectional view illustrating a sulfur lamp having metal electrodes according to a third non-limiting embodiment of the present invention.

As shown in FIG. 1, a sulfur lamp according to a first non-limiting embodiment of the present invention includes a transparent bulb 11 having a space 11*a* provided inside, a plurality of rods 12 symmetrically protruding from an outside surface of the transparent bulb and a plurality of metal electrodes 20, of which each is buried in (or encapsulated by) each of the rods. In this regard, one end of each electrode may be connected to a power supply and another end of each electrode may be inserted into the space 11*a*.

The lamp 10 may include a transparent bulb 11 made of quartz (which is thick enough to resist heat occurring within the space 11*a*), and the plurality of rods 12 into which portions of the metal electrodes 20 are respectively buried. Additionally, the plurality of rods may symmetrically protrude from the outside surface of the transparent bulb 11.

The transparent bulb 11, which may be provided having the space 11*a* therein, may contain a main light emitting material (contained in the space) such as, but not limited to, sulfur, and a subsidiary electric discharge material such as, but not limited to, argon, neon, zenon or krypton which may be used for initially switching on light.

The portion of the metal electrodes 20 are respectively buried into and fixedly supported by the rods 12. The rods 12 and the transparent bulb 11 may be formed as one body. Otherwise, the rods 12 and the transparent bulb 11 may be separately formed. The rods 12 may be later attached to the transparent bulb 11.

The metal electrode 20 may include an electrode 21 made of conductive material and a protective layer 22 having a thickness of about 2 mm coating the portion of the electrode 21 which may be inserted into the space 11*a* of the transparent bulb 11

The electrode 21 may be made of tungsten, as shown in FIG. 1, aluminum as shown in FIG. 2, or titanium as shown in FIG. 3. The protective layer 22 may be made of any suitable material that is resistant to high temperature and receptive to electron emission. For example, the protecting layer may be made of oxidized tungsten when the electrode 21 is made of tungsten, alumina when the electrode 21 is made of aluminum or deoxidized titanium when the electrode 21 is made of titanium.

A ribbon-typed molybdenum may be inserted between the rod 12 and the metal electrode 20 and between the transparent bulb 11 and the metal electrode 20, thereby alleviating differences in expansion and contraction between the metal electrodes and the quartz.

The structure, other than the electrode material, and operation of the sulfur lamp according to the first non-limiting embodiment of the present invention is now described.

The electric discharge, when electrical power is applied to the electrodes, occurs between the electrodes 20 with the transparent bulb 11 positioned in between. Thus, the subsidiary electric discharge material contained in the space changes to a plasma phase thereby generating energy. This energy may be transferred to sulfur is contained in the space. As a result, the sulfur 13 is changed from a solid phase to a liquid phase, and to a gas phase, and finally to a plasma phase, thereby emitting visible light.

At this point, contact of the electrode 21 with the space 11*a* may cause a violent chemical reaction of the electrode 21 with sulfur, thereby changing the electrode into a sulfide. This may cause the life of the electrode 21 to be shortened. However, according to the non-limiting embodiments of the present invention, the protective layer 22, which to coat the portion of the plurality of electrodes 21 inserted into the space 11*a*, prevents not only gas resulting from the chemical reaction from screening light, but also, the life of the electrode 21 from being shortened.

Operations of the sulfur lamps according to the second and third non-limiting embodiments of the present invention are the same as that of the sulfur lamp according to the first non-limiting embodiment. Therefore, descriptions of the operations are omitted.

The changing of sulfur contained in the space of the bulb into a plasma phase by using the electrodes (not the microwaves) eliminates a need for using a magnetron (which has a low energy transfer rate), thereby increasing a system efficacy and saving a cost for replacing the magnetron.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A sulfur lamp, comprising:

a power supply that supplies electrical power;

a transparent bulb which has a space provided therein, wherein sulfur is contained in the space; and a plurality of electrodes, wherein a portion of each electrode is inserted into the space, and an end of each electrode is connected to the power supply such that the sulfur is excited by an electric discharge thereby emitting light, wherein the portion of the electrode, which is inserted into the space, is coated with a protective layer, and wherein the protective layer comprises oxidized tungsten and the electrode comprises tungsten.

2. The sulfur lamp according to claim 1, wherein the transparent bulb further comprises:

a plurality of rods protruding from an outside surface of the transparent bulb, wherein a portion of each of the electrodes is encapsulated by the plurality of rods.

3. The sulfur lamp according to claim 2, wherein the transparent bulb and the rods are formed as a single body.

4. The sulfur lamp according to claim 2, wherein the rods and the transparent bulb are separately formed, and wherein the rods are configured to be later attached to the transparent bulb.

5. The sulfur lamp according to claim 1, wherein, in addition to the sulfur, a subsidiary electric discharge material that initially switches on light is contained in the space.

6. The sulfur lamp according to claim 5, wherein at least one or more subsidiary electric discharge materials selected from the group consisting of argon, neon, zenon and krypton are contained in the space.

7. The sulfur lamp according to claim 1, wherein a plurality of rods, into which portions of the electrodes are respectively encapsulated, is provided to symmetrically protrude from an outside surface of the transparent bulb.

8. The sulfur lamp according to claim 1, wherein molybdenum is inserted between the rod and the electrode and between the transparent bulb and the electrode.

9. A sulfur lamp, comprising:

a power supply that supplies electrical power;

a transparent bulb which has a space provided therein, wherein sulfur is contained in the space; and a plurality of electrodes, wherein a portion of each electrode is inserted into the space, and an end of each electrode is connected to the power supply such that the sulfur is excited by an electric discharge thereby emitting light, wherein the portion of the electrode, which is inserted into the space, is coated with a protective layer, and wherein the protective layer comprises alumina and the electrode comprises aluminum.

10. The sulfur lamp according to claim 9, wherein the transparent bulb further comprises:

a plurality of rods protruding from an outside surface of the transparent bulb, wherein a portion of each of the electrodes is encapsulated by the plurality of rods.

11. The sulfur lamp according to claim 10, wherein the transparent bulb and the rods are formed as a single body.

12. The sulfur lamp according to claim 10, wherein the rods and the transparent bulb are separately formed, and wherein the rods are configured to be later attached to the transparent bulb.

13. The sulfur lamp according to claim 9, wherein, in addition to the sulfur, a subsidiary electric discharge material that initially switches on light is contained in the space.

14. The sulfur lamp according to claim 13, wherein at least one or more subsidiary electric discharge materials selected from the group consisting of argon, neon, zenon and krypton are contained in the space.

15. The sulfur lamp according to claim 9, wherein a plurality of rods, into which portions of the electrodes are respectively encapsulated, is provided to symmetrically protrude from an outside surface of the transparent bulb.

16. The sulfur lamp according to claim 9, wherein molybdenum is inserted between the rod and the electrode and between the transparent bulb and the electrode.

17. A sulfur lamp, comprising:

a power supply that supplies electrical power;

a transparent bulb which has a space provided therein, wherein sulfur is contained in the space; and a plurality of electrodes, wherein a portion of each electrode is inserted into the space, and an end of each electrode is connected to the power supply such that the sulfur is excited by an electric discharge thereby emitting light, wherein the portion of the electrode, which is inserted into the space, is coated with a protective layer, and wherein the protective layer comprises deoxidized titanium and the electrode comprises titanium.

18. The sulfur lamp according to claim 17, wherein the transparent bulb further comprises:

a plurality of rods protruding from an outside surface of the transparent bulb, wherein a portion of each of the electrodes is encapsulated by the plurality of rods.

19. The sulfur lamp according to claim 18, wherein the transparent bulb and the rods are formed as a single body.

20. The sulfur lamp according to claim 18, wherein the rods and the transparent bulb are separately formed, and wherein the rods are configured to be later attached to the transparent bulb.

21. The sulfur lamp according to claim 17, wherein, in addition to the sulfur, a subsidiary electric discharge material that initially switches on light is contained in the space.

22. The sulfur lamp according to claim 21, wherein at least one or more subsidiary electric discharge materials selected from the group consisting of argon, neon, zenon and krypton are contained in the space.

23. The sulfur lamp according to claim 17, wherein a plurality of rods, into which portions of the electrodes are respectively encapsulated, is provided to symmetrically protrude from an outside surface of the transparent bulb.

24. The sulfur lamp according to claim 17, wherein molybdenum is inserted between the rod and the electrode and between the transparent bulb and the electrode.

* * * * *